US008413633B2

(12) United States Patent
Dunlavey

(10) Patent No.: US 8,413,633 B2
(45) Date of Patent: Apr. 9, 2013

(54) ROLLERIZED CRANKTRAIN BEDPLATE, RECIPROCATING ENGINE EMBODYING SAME AND ENGINE FURTHER INCLUDING ROLLERIZED CRANKTRAIN

(75) Inventor: Matthew Dunlavey, Ann Arbor, MI (US)

(73) Assignees: Hyundai Motor Company, Seoul (KR); Kia Motors Corporation, Seoul (KR); Hyundai America Technical Center, Inc., Superior Township, MI (US)

( * ) Notice: Subject to any disclaimer, the term of this patent is extended or adjusted under 35 U.S.C. 154(b) by 405 days.

(21) Appl. No.: 12/851,416

(22) Filed: Aug. 5, 2010

(65) Prior Publication Data

US 2012/0031366 A1 Feb. 9, 2012

(51) Int. Cl.
*F02F 7/00* (2006.01)

(52) U.S. Cl.
USPC ..... 123/195 H; 123/195 R; 384/294; 384/429

(58) Field of Classification Search ..... 123/195 R, 123/195 H, 197.1; 384/294, 429
See application file for complete search history.

(56) References Cited

U.S. PATENT DOCUMENTS 2,012,778 A * 8/1935 Shimer ..... 384/294

* cited by examiner

*Primary Examiner* — Noah Kamen
(74) *Attorney, Agent, or Firm* — Edwards Wildman Palmer LLP; Peter F. Corless

(57) ABSTRACT

Featured is a bedplate for a reciprocating engine having a rollerized cranktrain. Such a bedplate includes a peripheral support structure having sides and ends, a plurality of cross members that extend between the sides of the peripheral support structure, and a plurality of rolling element bearings. Each of the plurality of cross members includes a bearing support portion, the bearing support portion being configured so as to receive and retain therein a portion of one of the rolling element bearings. Also, the portion of the rolling element bearing is such that when the bedplate is secured to a cylinder block of the reciprocating engine, the bearing support portion rotatably supports a crankshaft of the reciprocating engine. Also featured is a reciprocating engine having such a bedplate.

20 Claims, 8 Drawing Sheets

ROLLERIZED CRANKTRAIN BEDPLATE, RECIPROCATING ENGINE EMBODYING SAME AND ENGINE FURTHER INCLUDING ROLLERIZED CRANKTRAIN

FIELD OF INVENTION

The present invention relates to a bedplate for a reciprocating engine, more particularly to a rollerized cranktrain bedplate and yet more particularly to a reciprocating engine having such a rollerized cranktrain bedplate.

BACKGROUND OF THE INVENTION

As known to those skilled in the art, reciprocating engines with hydrodynamic bearings typically use separate steel or iron main caps to mount and support the crankshaft to the cylinder block (regardless of the cylinder block material). The main caps are independently bolted with two or four vertical bolts per main cap. Additionally, in some case, the main caps can be tied to a deep skirted cylinder block via horizontally disposed bolts, for example, two bolts per main cap. The deep-skirt can either be integral to the cylinder block or be a bolt-on ladderframe. The deep skirt attachment allows for a stiffer cylinder block structure, which in turn can lead to more load capacity, higher power output and better noise, vibration and harshness (NVH) characteristics.

Referring now to FIG. 1, there is shown an illustrative reciprocating engine having a hydrodynamic cranktrain including a crankshaft 10, a connecting rod with a connecting rod big end and a plain bearing that is disposed between a surface of the crankshaft and an opposing surface of the connecting rod big end. In such an engine, the crankshaft 10 is rotatably supported by the main plain bearing(s) or hydrodynamic bearings 12 that are secured between the cylinder block 14 and the main bearing cap(s) 16, which are secured to the block. In such an engine, the piston is movably received in a cylinder and is rotatably coupled to the crankshaft by the connecting rod.

The hydrodynamic bearing 12 typically is arranged so as to have shell halves that are fit into the cylinder block 14 and the main bearing cap. Typically, such a hydrodynamic bearing 12 is circular and of uniform thickness in the radial direction, for example, a thickness in the radial direction of approximately 2 mm.

During the installation process, the cylinder block 14 is typically inverted when the crankshaft 10 is being installed on the bearing halve(s) that are fit into the cylinder block. Thereafter, the other bearing halve(s) are located and the main bearing cap(s) 16 are installed over the crankshaft. The main bearing cap(s) 16 are then secured to the cylinder block 14 using the main cap bolts 18. The number of main cap bolts 18, are dependent upon a number of factors such as the size and configuration of the engine; however, as shown in the illustrated embodiment, at least two bolts are used to secure the main caps(s) 16 to the cylinder block 14.

For purposes of increasing the strength and rigidity or stiffness of the cylinder block 12, a ladderframe 20 is bolted to the cylinder block 14. Typically the ladderframe 20 extends from a lower surface of the cylinder block 14 and is bolted about the periphery of the ladderframe so as to form a deep skirted cylinder block. There typically is no direct structural joint between the ladderframe and the main caps.

It also should be recognized that in the illustrated embodiment, the cylinder block 14 and ladderframe 20 are made of aluminum; however the main cap(s) 16 are made of a steel or other such material. Consequently, there is differential thermal expansion between the main caps 16 and the cylinder block 14 and the ladderframe 20, which must be taken into account when designing the engine.

As indicated above, plain hydrodynamic bearings are used in conventional reciprocating engines to rotatably support the connecting rod and the crankshaft 10. In order to improve engine performance, it has been considered to replace the plain bearings with roller element or roller type bearings 22 (FIG. 2). Referring now to FIG. 2 there is shown a cross-sectional side view of a cylinder block 24 that is operably coupled to the crankshaft 10 illustrating use of such a roller type bearing using conventional techniques. As with a conventional engine, the connecting rod, more particularly the connecting rod big end 23, is rotatably supported off the crankshaft 10 by a roller bearing that is disposed between a surface of the crankshaft and an opposing surface of the connecting rod big end. Similarly, the crankshaft 10 is rotatably supported by another rolling bearing 24 between the cylinder block and main cap(s) 26.

Such a roller bearing; however, is typically thicker than a hydrodynamic bearing. For example and as shown in FIG. 2, a roller type bearing is approximately 11 mm thick, where the outer steel race is about 3.5 mm in thickness and the caged needle bearings (e.g., plastic caged needle bearings) is approximately 7.5 mm in thickness. As a result of this increased thickness as compared to the typical hydrodynamic bearing, material must be removed from the cylinder block and the bearing caps for use of the thicker rolling bearing element. Removal of such material tends to weaken the cylinder block and the main bearing caps. As there is no direct structural joint between a ladder frame and the main caps, the ladderframe cannot compensate for the loss of strength for the main caps and the cylinder block.

It thus would be desirable to provide a bedplate that connects to the cylinder block and which increases the rigidity of the cylinder block as well as functionally replacing the main caps of a conventional engine. It would be particularly desirable to provide such a bedplate that is made of similar material as the cylinder block so as to minimize the effect of thermal expansion between the bedplate and the cylinder block. It also would be particularly desirable to reduce part counts while maintaining structural requirements. It would be yet further desirable to provide such a bedplate that can be as easily installed as the lower support structures of conventional cylinder blocks and usable with rollerized cranktrains as herein described.

SUMMARY OF THE INVENTION

The present invention features a bedplate for a reciprocating engine having a rollerized cranktrain. Such a bedplate includes a peripheral support structure having sides and ends, a plurality of cross members that extend between the sides of the peripheral support structure, and a plurality of rolling element bearings. Each of the plurality of cross members includes a bearing support portion, the bearing support portion being configured so as to receive and retain therein a portion of one of the rolling element bearings. Also, the portion of the rolling element bearing is such that when the bedplate is secured to a cylinder block of the reciprocating engine, the bearing support portion rotatably supports a crankshaft of the reciprocating engine.

In embodiments of the present invention, such a bedplate further includes a base member, where the base member is coupled to each of the cross-members. Also, at least one of the plurality of cross-members includes a through aperture running parallel to a bore of the bearing support portion and the base member includes at least one windage opening, the windage opening being located so that an end of the through aperture is fluidly coupled to the windage opening.

In further embodiments, such a bedplate further includes a plurality of bolts and where the bearing support portion includes a plurality of through apertures that extend vertically through a portion of the bearing support portion. The plurality of bolts are received in the plurality of through aperture and secured to the cylinder block, thereby securing the bearing support portion to the cylinder block. In yet further embodiments, there are two through apertures and two bolts for securing the bedplate at each bearing support portion to the cylinder block. In yet another further embodiment, there are four through apertures and four bolts for securing the bedplate at each bearing support portion to the cylinder block.

In yet further embodiments, the bedplate is made of a material similar to a material of the cylinder block. In yet another embodiment, the cylinder block is primarily made of aluminum and the bedplate is made of one of aluminum or magnesium.

In yet further embodiments, the bedplate further includes a lubricant gallery for supplying lubricant to a cylinder wall(s) and crankshaft of the reciprocating engine. Also, the bedplate can further include a plurality of oil drains so that lubricant can drain to an oil pan mounted to the bedplate.

According to another aspect of the present invention, there is featured a reciprocating engine that includes a cylinder block, a crankshaft, a plurality of roller element bearings for rotatably supporting the crankshaft, and a bedplate. Such a bedplate comprises any of the bedplates described above and/or herein.

In yet further embodiments, the cylinder block of such a reciprocating engine is configurable so as to include 4 cylinders, 6 cylinders, 8 cylinders, 10 cylinders or 12 cylinders, and where the number of pistons corresponds to the number of cylinders. Such cylinders are arranged in the reciprocating engine so as to be inline, slanted, form a V, or arranged in any of a number of ways as known to those skilled in the art.

In yet further embodiments, the reciprocating engine is a four-stroke internal combustion engine or a two-stroke internal combustion engine.

In yet further embodiments, the reciprocating engine includes a crankshaft and at least one connecting rod operably coupled to said at least one piston and the crankshaft such that linear motion of the at least one piston in the at least one cylinder causes rotation of the crankshaft. Such a reciprocating engine also further includes a rolling element bearing that rotatably supports the crankshaft during operation of the reciprocating engine.

Other aspects and embodiments of the invention are discussed below.

Definitions

The instant invention is most clearly understood with reference to the following definitions:

As used in the specification and claims, the singular form "a", "an" and "the" include plural references unless the context clearly dictates otherwise.

As used herein, the term "comprising" or "including" is intended to mean that the compositions, methods, devices, apparatuses and systems include the recited elements, but do not exclude other elements. "Consisting essentially of", when used to define compositions, devices, apparatuses, systems, and methods, shall mean excluding other elements of any essential significance to the combination. Embodiments defined by each of these transition terms are within the scope of this invention.

USP shall be understood to mean U.S. patent Number, namely a U.S. patent granted by the U.S. Patent and Trademark Office.

TDC shall be understood to mean top dead center and relates to a specific location or position of the piston within the cylinder as it moves linearly within the cylinder.

BDC shall be understood to mean bottom dead center and relates to a specific location or position of the piston within the cylinder as it moves linearly within the cylinder.

NVH shall be understood to mean noise, vibration and harshness.

BRIEF DESCRIPTION OF THE DRAWING

For a fuller understanding of the nature and desired objects of the present invention, reference is made to the following detailed description taken in conjunction with the accompanying drawing figures wherein like reference character denote corresponding parts throughout the several views and wherein.

DESCRIPTION OF THE PREFERRED EMBODIMENT

Figure 1:
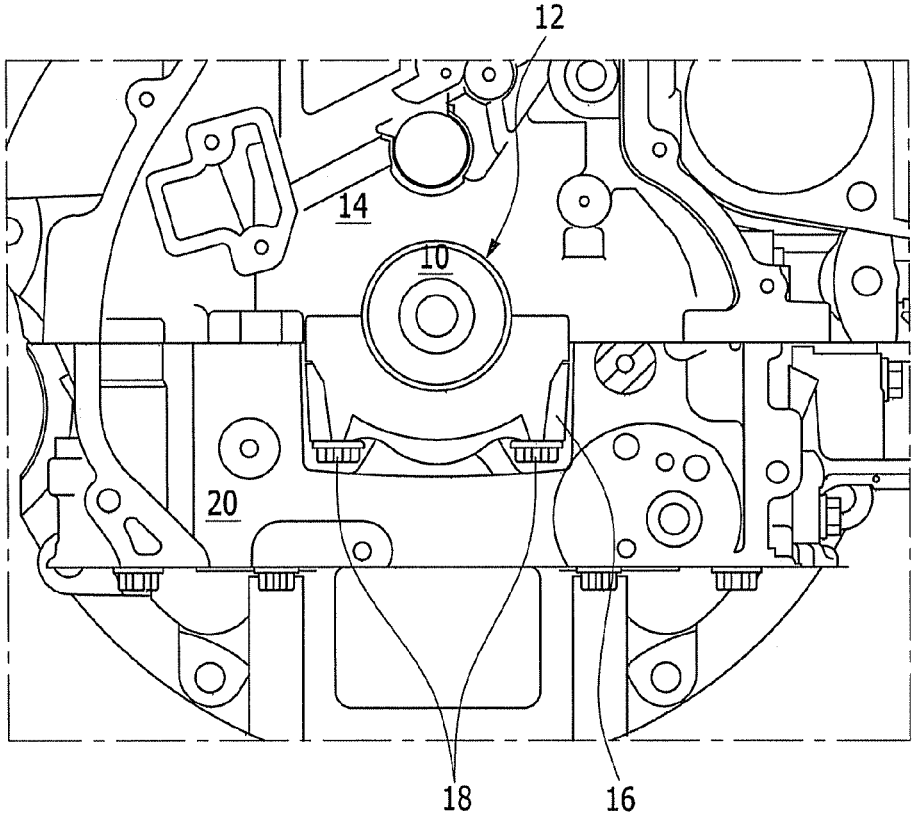
FIG. 1 PRIOR ART
FIG. 1 is a cross-sectional end view of a conventional reciprocating engine with a conventional hydrodynamic bearing and ladderframe.
Figure 2:
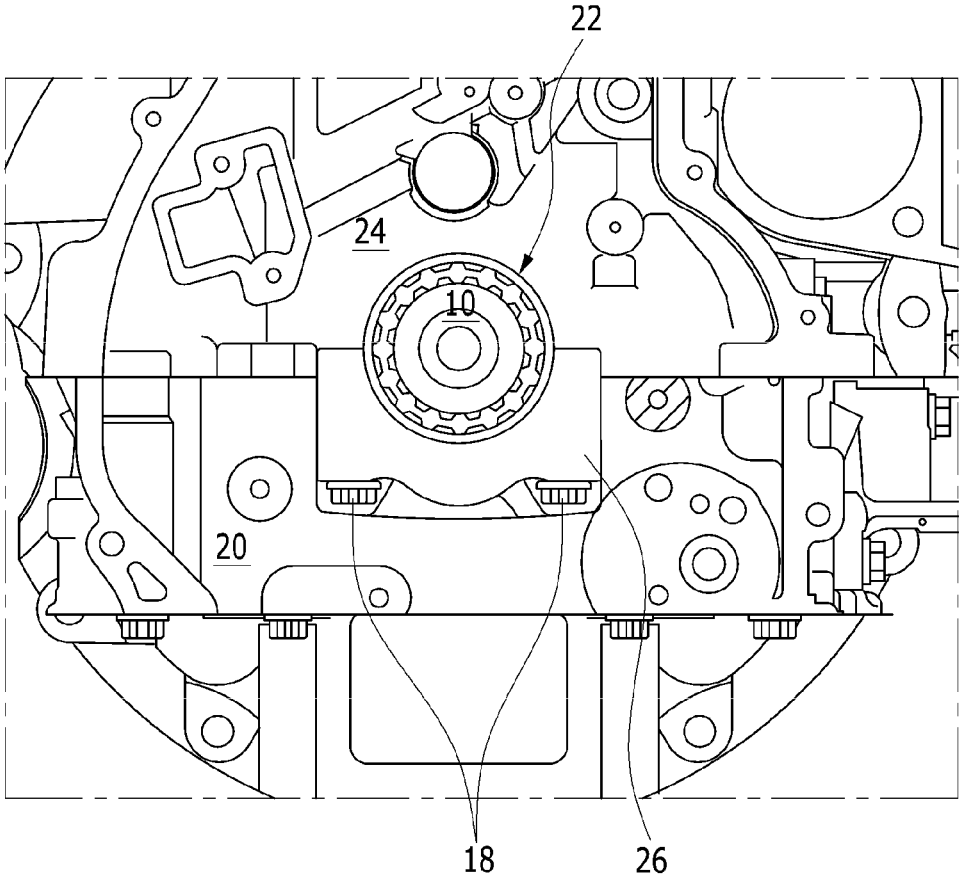
FIG. 2 is a cross-sectional end view of a reciprocating engine with a ladderframe illustrating use of a roller type bearing for the crankshaft.
Figure 3:
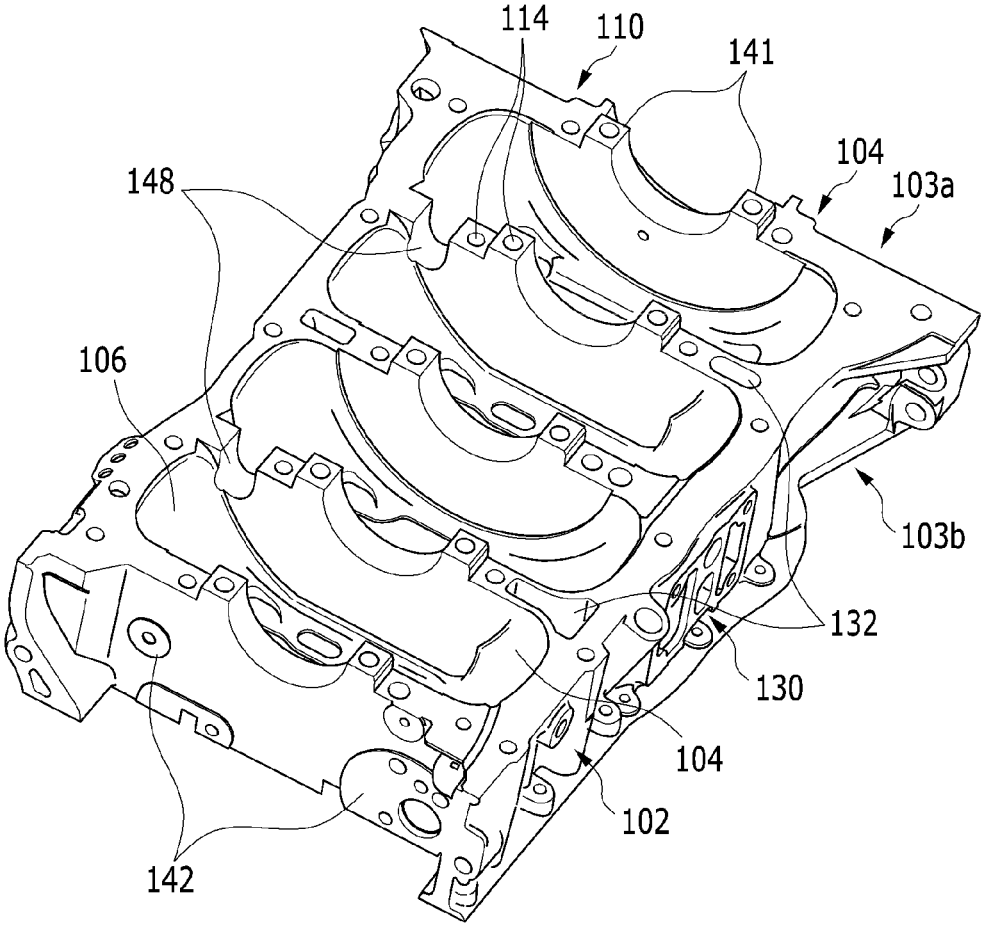
FIG. 3 is a perspective top view of a bedplate according to the present invention.
Figure 4:
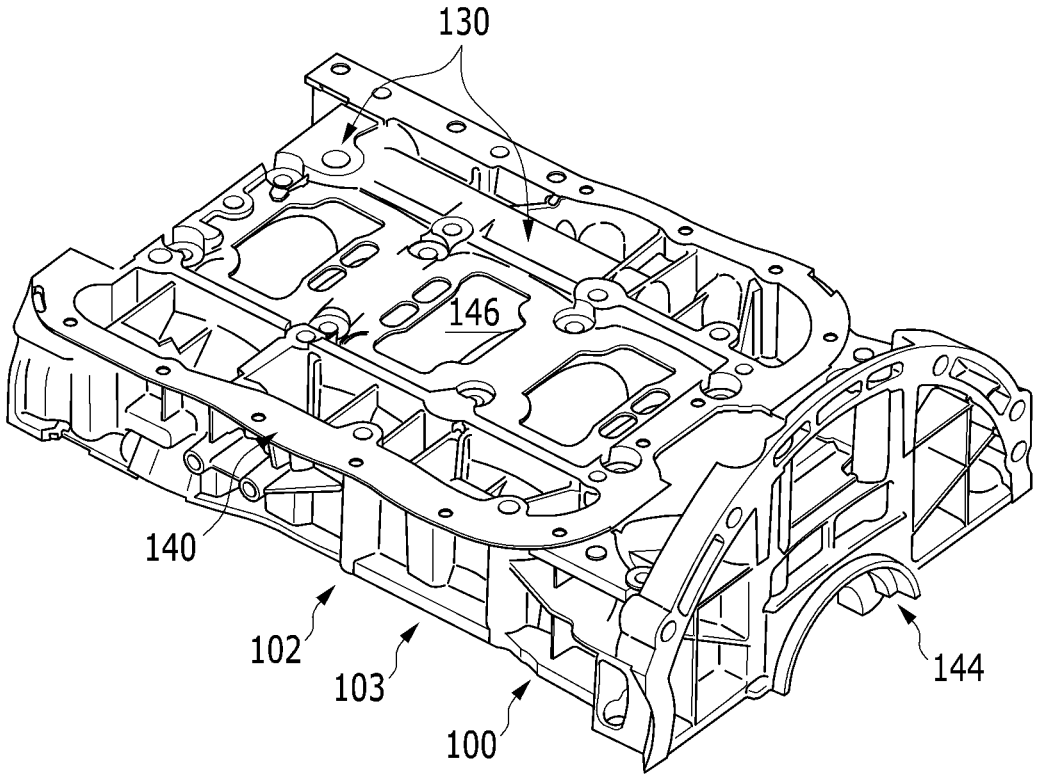
FIG. 4 is a perspective bottom view of the bedplate of FIG. 3.
Figure 5:
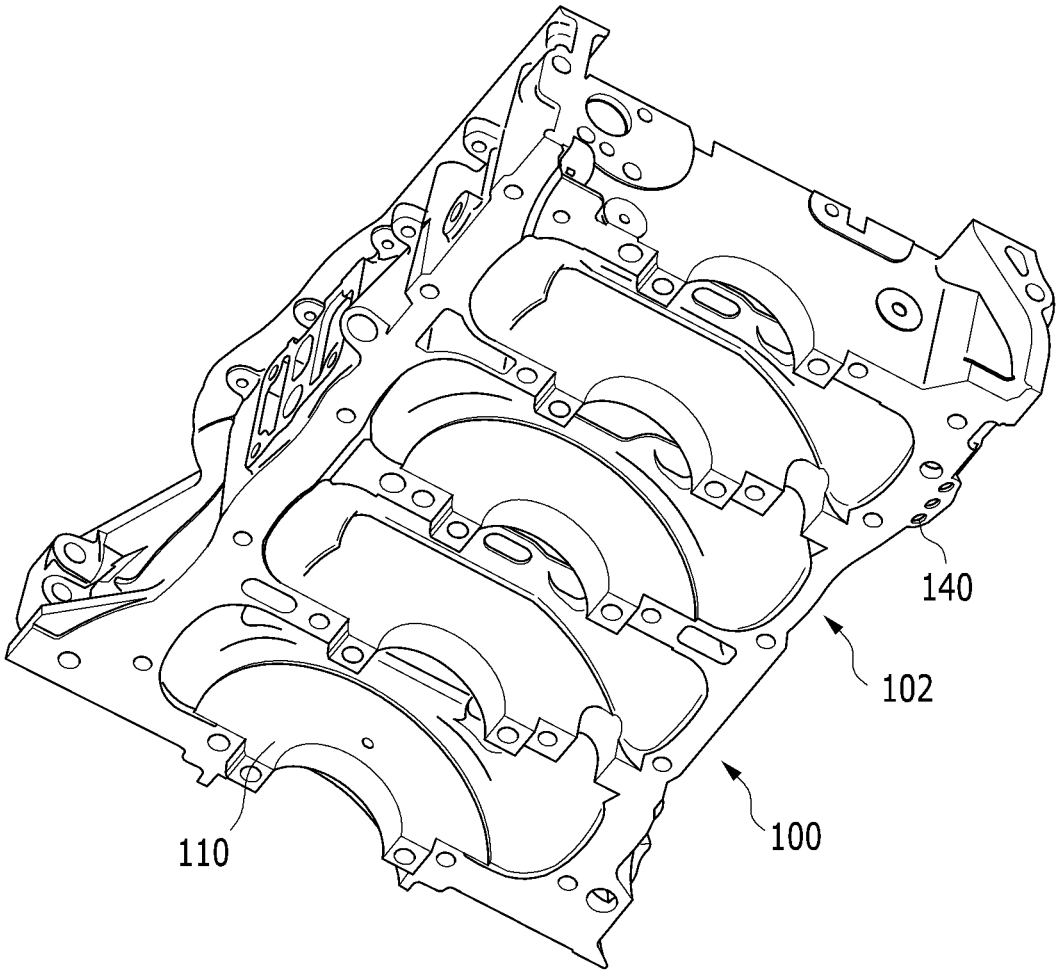
FIG. 5 is a perspective cross-sectional bottom view of the bedplate of FIG. 4.

Referring now to the various figures of the drawing wherein like reference characters refer to like parts, there are shown in FIGS. 3-5 respectively, a perspective top view of a bedplate 100 according to the present invention (FIG. 3), a perspective bottom view of such a bedplate (FIG. 4), and a perspective cross-sectional bottom view of such a bedplate (FIG. 5) with certain bedplate structure (e.g., base member) removed for clarity. The bedplate 100 is secured to a lower region of the cylinder block 50 and is enclosed by the oil pan (not shown) as is known to those skilled in the art. The oil pan is secured to the bed plate at the lower oil pan mounting surface/interface 140.

Figure 7A:
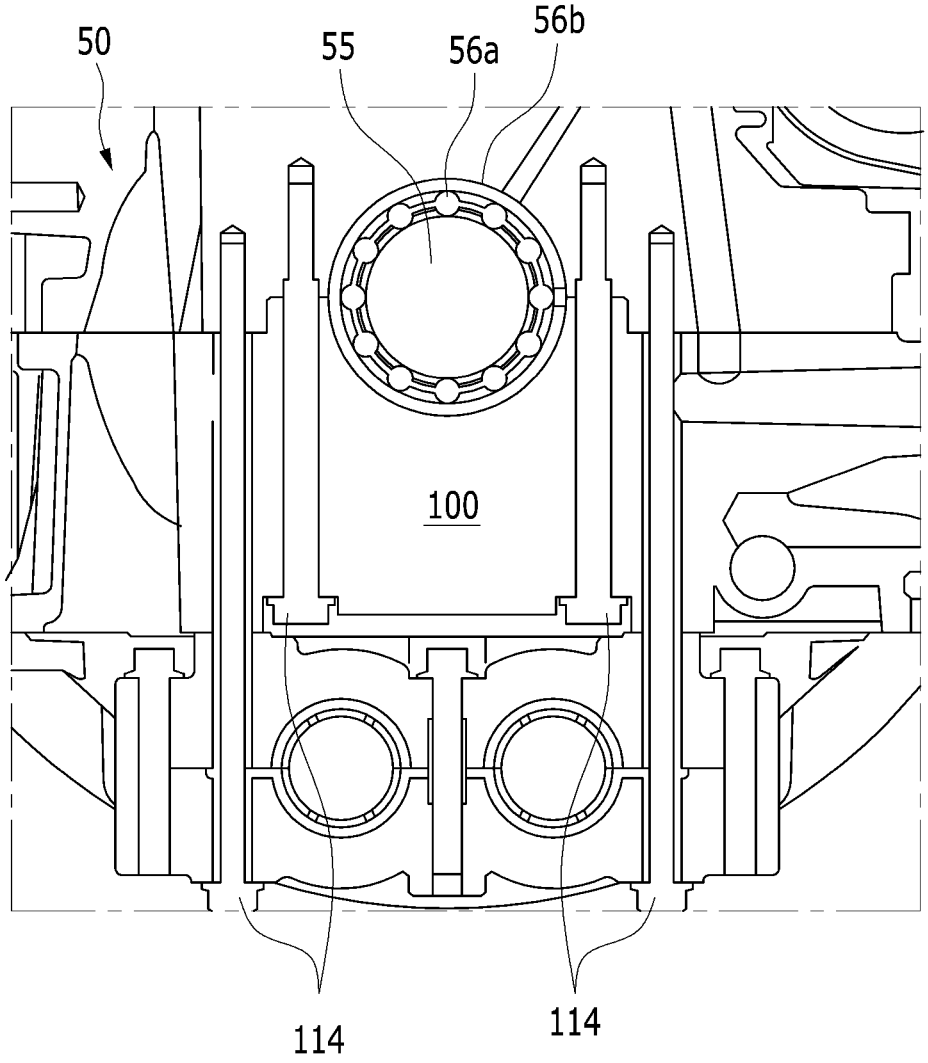
FIGS. 7A, B are cross-sectional views illustrating different bolt arrangements.

As described further herein, the bedplate of the present invention is configured and arranged so as to allow lubricants to drain through the bedplate to the oil pan as is similar to operation of a conventional reciprocating engine without such a bedplate. Reference also should be made to FIGS. 7A, B in particular for the location, structure and arrangement of the rolling element bearings 56 embodied in the cylinder block 50 of a reciprocating engine.

Such a bedplate 100 preferably is composed primarily of a single material such as aluminum, steel, or magnesium or other material known in the art and otherwise appropriate for the intended use. In an illustrative embodiment, the bedplate

100 is a casting as is known to those skilled in the art. The mold for such a casting preferably is arranged so as to yield a bedplate as described further herein. It also is within the scope of the present invention to utilize other manufacturing techniques known to those skilled in the art (e.g., machining), alone or in combination with such a casting process to yield a bedplate as herein described. In more specific embodiments, the bedplate is a cast aluminum or magnesium bedplate suitable for use with aluminum cylinder blocks.

Such a cast aluminum or magnesium bedplate when used with an aluminum cylinder block improves the assembly and structural stiffness of an engine embodying a rollerized cranktrain. In addition, such a cast aluminum or magnesium bedplate also is configurable so that the main bearing outer races can be arranged so as to be separate part or integral to the bedplate/cylinder block castings. As similar materials are utilized, this will advantageously allow machine operations and tolerances to be optimized to improve the NVH characteristics, fuel economy, power and durability of the engine. Also, the elimination of main caps and bolts will ease assembly, lower costs, reduce mass and part counts.

Such a bedplate 100 includes an outer perimeter vertical structure 102 that generally defines the ends 103*a* and sides 103*b* of the bedplate, such an outer perimeter structure 102 also is configured and arranged so as to other wise allow for flow of lubricants and breathing as is known to those skilled in the art. The outer perimeter vertical structure 102 also is configurable with a plurality of though apertures and associated bolts, so that the bolts are inserted through the through apertures and the bolts threadably secured to the cylinder block.

Such a bedplate 100 also includes a plurality of cross members 104 that extend between the sides 103*b* of the outer perimeter vertical structure 102. Each cross-member 104 is each configured and arranged so as to include a bearing support structure 110 that is configured to supporting a roller bearing 56 and the crankshaft 55. As is known to those skilled in the art, the number of cross-members 104 relates to the number of cylinders embodied in the engine plus two, one for each cross-member corresponding to the ends 103*a* of the bedplate. Such bearing support structure 110 is generally configured so as to be capable of withstanding the forces and moments associated with operation of the crankshaft, supporting the outer race 56*a* and roller bearing elements 56*b*, and rotatably supporting the crankshaft.

Each cross-member 104, more particularly the bearing support structure 110 thereof includes a plurality of through apertures 112 that extend in a vertical direction in which are received the main bolts 114 that secure the bearing support structure and a portion of the bedplate to the cylinder block 50. During assembly, after mounting the bedplate 100 to the cylinder block 50, the main bolts 114 are inserted into these through apertures and the bolts are threadably secured to the cylinder block. As is known to those skilled in the art, the bolts are tightened to the appropriate amount so as to secure the bedplate and thus also the rolling element bearings and crankshaft to the cylinder block. In the illustrated embodiment, the bearing support structure 110 is configured so as to include four bolts per cross-member 104.

In general, the bearing support structure includes at least two bolt holes and bolts for securing the bearing support structure portion of the bedplate to the cylinder block. In yet further embodiments, the through apertures 112 embody a stepped structure having two diameters, where the diameter of one portion is established so that the threaded portion of the bolt passes there through but not the head and a second portion having a diameter larger than the head of the bolt so that the head is recessed within the second portion.

Figure 7B:
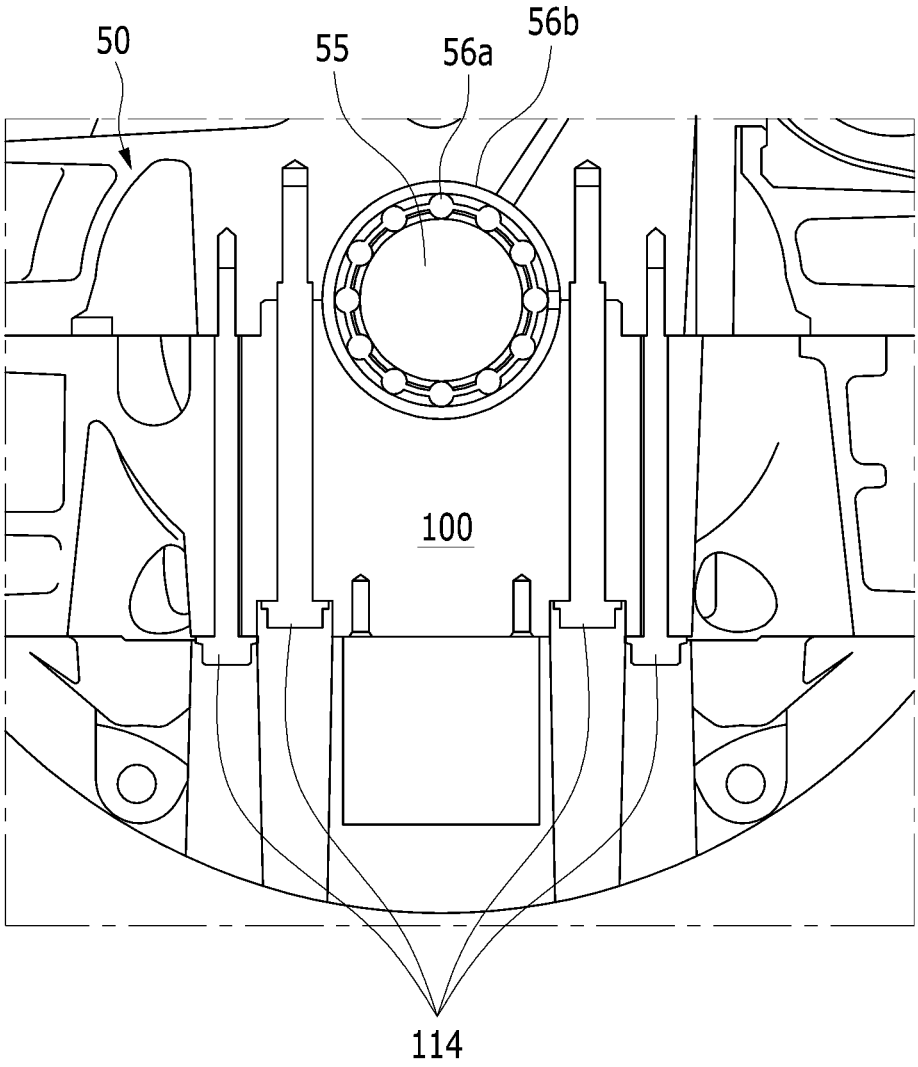

Referring now also to FIGS. 7A, B, the cylinder blocks are configurable so that different length main bolts 114 are used to secure the bedplate 100 to the cylinder block 50. In the exemplary embodiment shown in FIG. 7A, the main bolts are of two different lengths. where the inside pair of bolts are shorter than the outside pair of bolts. In the exemplary embodiment shown in FIG. 7B, the inside and outside pairs of bolts are of equal length. In further embodiments, the bedplate is established as described above, so that that the bolt heads for the outside pair of main bolts 114, are at different vertical locations so that even though the bolts are of equal length they end at different locations in the cylinder block as compared to that for the inside pair of bolts. In addition, the main bolts 114 also are configurable so that different pairs of bolts have different diameters.

Such cross-members 104 are coupled to a base member 106, which base member generally extends from the ends 103*a* and sides 103*b* of the outer perimeter vertical structure 102 as well as between each cross member 104 to form a generally arcuate structure. The cross members 104 are coupled to such a base member 106 so the bottom portion of the cross-member does not move in an axial direction such as along the main line bore 101. In other words the base member provided axial stiffness for each cross-member 104. The base member 106 also provides additional lateral stiffness to the outer perimeter vertical structure 102 (i.e., in a direction transverse to the main line bore).

As described herein, the outer race 56*a* of the roller bearing 56 is a separate structure or is integrated into the bedplate 100. Thus, in further embodiments, using the casting process or other technique known to those skilled in the art, the bearing support structure 110 is further configured and arranged so as to embody the outer race 56*b* or a portion thereof. Thus, in one embodiment, when the support bearing 56 is assembled, the needle bearing elements 56*b* would be inserted into the outer race during assembly.

As described herein the bedplate 100 is configured and arranged so as to provide passage ways so that lubricants (e.g., oil) can pass to the oil pan and also that there are breathing passages so as to that the movement of the engine functionalities are not adversely impacted because of closed regions. In particular, the bedplate is configurable so as to include, for example, lubrication system galleries 130 which provide lubricant for lubrication of the cylinder walls and bearings, and lubricant drains 132. In addition, the base member is configurable with windage openings 146 and one or more of the cross-members 110 is configured with a through aperture that extends axially, the one or more aperture acting as a inter-bay breathing window 148.

One end of the base plate 110 is configurable so as to include a crankshaft lip sealing provision 144 as is known to those skilled in the art for sealing the end of the crankshaft such that the lubricant does not exit axially along the crankshaft. In addition, the other end of the base plate 100 is configurable with engine component mounts, for example, engine timing drive component mounting interfaces 142 such as those for a tensioner, guides or the like are provided so that the engine components can be mounted to the bedplate. Also, it is within the scope of the present invention for other engine functionalities, such as a bottom mounted oil pump and or balance shaft module, can be attached to the bedplate by an appropriate attachment.

In further embodiments, the bedplate 100 is located with respect to the cylinder block 50 by means of dowels/pins sleeves and/or via a register channel 141. In yet further embodiments, it is within the scope of the present invention for the main line bore 101 of the bedplate 100 to be finished when the bedplate is mounted to the cylinder block. As similar materials for the cylinder block 50 and bedplate are utilized, the line bore machining processes and finishes can be refined to accurately control the sizing and tolerance to better optimize cranktrain operation (e.g., lowest friction).

In further embodiments, such a roller bearing 56 or rolling element bearing is any of a number of roller element bearings known to those skilled in the art and appropriate for the intended use. In exemplary embodiments, the roller bearing 56 embodies a multiplicity of needle bearings or needle bearing elements 56*b* that are arranged so as to be disposed about an outer surface of the crankshaft 120 and an inner surface of the opposing structure of the bedplate 100. Such a needle type of roller bearing further includes an outer race 56*a* that is configured so as to prevent axial movement of the needle bearing elements 56*b* when installed without interfering with the rotational movement. This arrangement of roller bearings in combination with the crankshaft is referred to herein for simplicity as a rollerized crankshaft.

Figure 6:
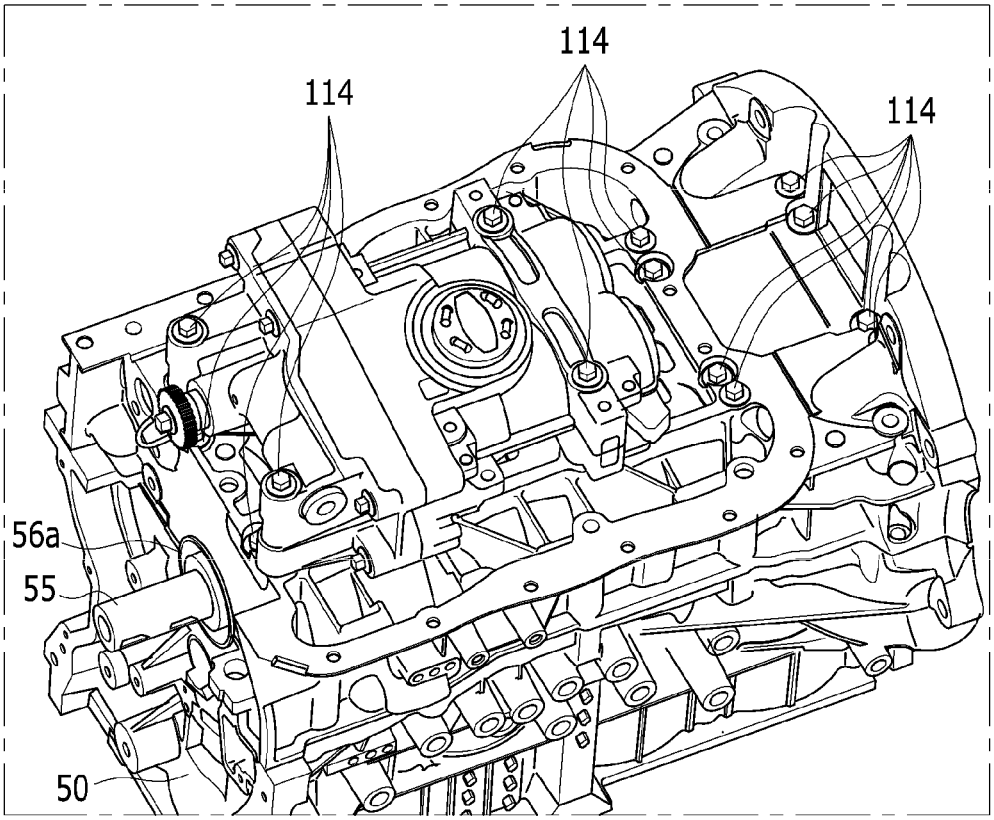
FIG. 6 is perspective bottom view of a 4 cylinder reciprocating engine with the bedplate attached thereto.

As indicated herein and as shown in FIG. 6, in further aspects of the present invention, there is featured a reciprocating engine including a cylinder block, a rollerized cranktrain as herein described and a bedplate as also herein described.

In yet further embodiments, the block of such a reciprocating engine is configured so as to include 4 cylinders, six cylinders, 8 cylinders, 10 cylinders and 12 cylinders, and where the number of pistons corresponds to the number of cylinders. Such cylinders are arranged in the reciprocating engine so as to be inline, slanted, form a V, or arranged in any of a number of ways as one known to those skilled in the art.

In yet further embodiments, the reciprocating engine is a four-stroke internal combustion engine or a two-stroke internal combustion engine.

Although a preferred embodiment of the invention has been described using specific terms, such description is for illustrative purposes only, and it is to be understood that changes and variations may be made without departing from the spirit or scope of the following claims.

Incorporation by Reference

All patents, published patent applications and other references disclosed herein are hereby expressly incorporated by reference in their entireties by reference.

Equivalents

Those skilled in the art will recognize, or be able to ascertain using no more than routine experimentation, many equivalents of the specific embodiments of the invention described herein. Such equivalents are intended to be encompassed by the following claims.

What is claimed is:

1. A bedplate for a reciprocating engine having a rollerized cranktrain, comprising a peripheral support structure having sides and ends;

a plurality of cross members that extend between the sides of the peripheral support structure;

a plurality of rolling element bearings;

wherein each of the plurality of cross members includes a bearing support portion, the bearing support portion being configured so as to receive and retain therein a portion of one of the rolling element bearings; and wherein the portion of the rolling element bearing is such that when the bedplate is secured to a cylinder block of the reciprocating engine, the bearing support portion rotatably supports a crankshaft of the reciprocating engine.

2. The bedplate of claim 1, further comprising a base member and wherein the base member is coupled to each of the cross-members.

3. The bedplate of claim 2, wherein at least one of plurality of cross-members includes a through aperture running parallel to a bore of the bearing support portion and the base member includes at least one windage opening, the windage opening being located so that an end of the through aperture is fluidly coupled to the windage opening.

4. The reciprocating engine of claim 2, wherein at least one of plurality of cross-members includes a through aperture running parallel to a bore of the bearing support portion and the base member includes at least one windage opening, the windage opening being located so that an end of the through aperture is fluidly coupled to the windage opening.

5. The bedplate of claim 1, further comprising:

a plurality of bolts;

wherein the bearing support portion includes a plurality of through apertures that extend vertically through a portion of the bearing support portion; and wherein the plurality of bolts are received in the plurality of through aperture and secured to the cylinder block.

6. The bedplate of claim 5, wherein there are two through apertures and two bolts for securing the bedplate at each bearing support portion to the cylinder block.

7. The bedplate of claim 5, wherein there are four through apertures and four bolts for securing the bedplate at each bearing support portion to the cylinder block.

8. The bedplate of claim 1, being made of a material similar to a material of the cylinder block.

9. The bedplate of claim 8, wherein the cylinder block is primarily made of aluminum and the bedplate is made of one of aluminum or magnesium.

10. The bedplate of claim 1, further comprising a lubricant gallery for supplying lubricant to a cylinder wall(s) and crankshaft of the reciprocating engine.

11. The bedplate of claim 1, further comprising oil drains so that lubricant can drain to an oil pan mounted to the bedplate.

12. The reciprocating engine of claim 1, wherein the bedplate further includes:

a plurality of bolts;

wherein the bearing support portion includes a plurality of through apertures that extend vertically through a portion of the bearing support portion; and wherein the plurality of bolts are received in the plurality of through aperture and secured to the cylinder block.

13. The reciprocating engine of claim 12, wherein the bedplate further includes two through apertures and two bolts for securing the bedplate at each bearing support portion to the cylinder block.

14. The reciprocating engine of claim 13, wherein the bedplate further includes four through apertures and four bolts for securing the bedplate at each bearing support portion to the cylinder block.

15. A reciprocating engine including a cylinder block;

a crankshaft;

a plurality of roller element bearings for rotatably supporting the crankshaft; and bedplate, said bedplate including a peripheral support structure having sides and ends;

a plurality of cross members that extend between the sides of the peripheral support structure;

wherein each of the plurality of cross members includes a bearing support portion, the bearing support portion being configured so as to receive and retain therein a portion of one of the rolling element bearings; and wherein the portion of the rolling element bearing is such that when the bedplate is secured to the cylinder block, the bearing support portion rotatably supports the crankshaft.

16. The reciprocating engine of claim 15, wherein the bedplate further comprises a base member and wherein the base member is coupled to each of the cross-members.

17. The reciprocating engine of claim 15, wherein the bedplate is made of a material similar to a material of the cylinder block.

18. The reciprocating engine of claim 15, wherein the cylinder block is primarily made of aluminum and the bedplate is made of one of aluminum or magnesium.

19. The reciprocating engine of claim 15, wherein the bedplate further includes a lubricant gallery for supplying lubricant to a cylinder wall(s) and crankshaft of the reciprocating engine.

20. The reciprocating engine of claim 15, wherein the bedplate further includes oil drains so that lubricant can drain to an oil pan mounted to the bedplate.

* * * * *